US006186474B1

(12) United States Patent
Fitzner et al.

(10) Patent No.: US 6,186,474 B1
(45) Date of Patent: Feb. 13, 2001

(54) INJECTION VALVE WITH A COMPENSATING SURFACE

(75) Inventors: Johannes Fitzner, Bernhardswald; Jürgen Rink, Wackersdorf, both of (DE)

(73) Assignee: Siemens Aktiengesellschaft, Munich (DE)

( * ) Notice: Under 35 U.S.C. 154(b), the term of this patent shall be extended for 0 days.

(21) Appl. No.: 09/379,216

(22) Filed: Aug. 23, 1999

Related U.S. Application Data

(63) Continuation of application No. PCT/DE98/03555, filed on Dec. 2, 1998.

(30) Foreign Application Priority Data

Dec. 23, 1997 (DE) ..... 197 57 659

(51) Int. Cl.[7] ..... F02M 51/06
(52) U.S. Cl. ..... 251/229; 251/129.2; 251/251
(58) Field of Search ..... 251/58, 129.2, 251/229, 251, 257, 258, 261

(56) References Cited

U.S. PATENT DOCUMENTS 2,563,868 * 8/1951 Reichard ..... 251/229
4,071,047 * 1/1978 Greene ..... 251/129.2
4,101,076 7/1978 Bart .
4,352,483 * 10/1982 Iacoponi ..... 251/229
4,508,142 * 4/1985 Eburn, Jr. et al. ..... 251/251
5,556,072 * 9/1996 Itoi et al. ..... 251/58

FOREIGN PATENT DOCUMENTS

19624001A1 12/1997 (DE) .
0770776A1 5/1997 (EP) .

OTHER PUBLICATIONS

"Ein neues elektronisches Hochdruck–Einspritzsystem für Dieselmotoren", Martin Rupmhorst, MTZ Motortechnische Zeitschrift 56, 1995, pp. 142–148.

* cited by examiner

*Primary Examiner*—Kevin Shaver
*Assistant Examiner*—Eric Keasel
(74) *Attorney, Agent, or Firm*—Herbert L. Lerner; Laurence A. Greenberg; Werner H. Stemer

(57) ABSTRACT

A compensating element is disposed between a piezoelectric actuator and one or more transmission elements. The compensating element has a curved surface that bears against the piezoelectric actuator. The compensating element compensates for both a tilting of the piezoelectric actuator and, if two transmission elements are provided, for a difference in an overall height of the transmission elements.

12 Claims, 6 Drawing Sheets

INJECTION VALVE WITH A COMPENSATING SURFACE

CROSS-REFERENCE TO RELATED APPLICATION:

This is a continuation of copending International Application PCT/DE98/03555, filed Dec. 2, 1998, which designated the United States.

BACKGROUND OF THE INVENTION

FIELD OF THE INVENTION

The invention pertains to an injection valve for an internal combustion engine. The injection valve has a housing in which an actuator is disposed and guided in a given direction of movement. The actuator is operatively connected to the controlling element.

Injection valves with piezoelectric actuators are used, for example, in motor vehicle technology. The actuator thereby bears directly on a controlling element. As a result, however, tilting of the actuator is transmitted directly to the transmission element. Moreover, any unevenness of the plane surfaces of the controlling element and of the actuator which rest against one another causes the actuator and the controlling element to be subjected to load on one side, with the result that the transmission of the deflection is impaired and the uneven point is subject to increased wear.

SUMMARY OF THE INVENTION

It is accordingly an object of the invention to provide an injection valve with a compensating surface, which overcomes the above-mentioned disadvantages of the heretofore-known devices and methods of this general type and which is subject to improved force transmission between the actuator and the controlling element and which compensates for maladjustment or unevenness between the actuator and the controlling element.

With the foregoing and other objects in view there is provided, in accordance with the invention, an injection valve of an internal combustion engine, comprising:

a housing;

an actuator disposed in the housing and movably guided in the housing along a given direction of movement; and a controlling element moveably guided along a given direction of movement and being operatively connected to the actuator via at least one curved surface.

In other words, the objects of the invention are satisfied in that the actuator and the controlling element are operatively connected to one another via a curved compensating surface which compensates for any maladjustment of the actuator or of the controlling element.

In accordance with an added feature of the invention, a compensating element is moveably disposed in the housing between the controlling element and the actuator, the actuator and the controlling element bearing against the compensating element and the compensating element being formed with the at least one curved surface;

the compensating element, in a region bearing against one of the actuator and the controlling element, having a curvature inclined to the respective actuator or controlling element, such that a bearing point at which the compensating element bears against the one of the actuator and the controlling element is fixed exactly and is scarcely displaced upon a tilting of the one of the actuator and the controlling element.

The compensating element between the actuator and the controlling element provides for an advantageous development of the invention. The compensating element, in the region in which the actuator bears on the compensating element, has a positive curvature which is curved toward the actuator. The positive curvature of the compensating element ensures that the predetermined bearing point is maintained even when the actuator is offset and/or inclined relative to the predetermined position. The optimum transmission direction is therefore maintained even when the actuator is maladjusted. Increased wear is also avoided.

In accordance with an additional feature of the invention, a transmission element is disposed between the compensating element and the controlling element;

the transmission element bearing against the housing at a first bearing point, against the controlling element at a second bearing point, and against the compensating element at a third bearing point; and the compensating element having a substantially plane surface at the third bearing point and the curved surface facing towards the actuator.

In accordance with another feature of the invention, there are provided two substantially identical transmission elements (a first transmission element and a second transmission element). The second transmission element is disposed between the compensating element and the controlling element and, together with the first transmission element, symmetrically to a center axis of symmetry of the assembly.

In accordance with a further feature of the invention, the first transmission element bears against the controlling element at the first bearing point and the second transmission element bears against the controlling element at the second bearing point, and wherein the first and second bearing points are equidistant from the center axis of symmetry.

In accordance with again an added feature of the invention, the compensating element is guided laterally in the direction of movement of the actuator by the housing.

In accordance with again an additional feature of the invention, the compensating element is formed as a part-sphere.

In accordance with again another feature of the invention, the first bearing point and the second bearing point are disposed approximately on a common plane, and the third bearing point is located between the first and second bearing points, as seen projected onto the common plane.

In accordance with again a further feature of the invention, the compensating element is guided in the housing in the direction of movement of the actuator, the compensating element is a cylindrical body having a top side defining a part-spherical surface and a substantially planar underside, the actuator has a substantially planar surface bearing against the part-spherical surface, and the controlling element bears against the substantially planar underside of the compensating element.

In accordance with yet again a further feature of the invention, the actuator is formed with a curved surface towards the controlling element, or the controlling element is formed with a curved surface towards the actuator.

In accordance with a concomitant feature of the invention, the compensating element is moveably disposed in the housing between the controlling element and the actuator; the actuator and the controlling element bear against the compensating element; and the compensating element, at least in a region wherein the actuator or the controlling element bears against the compensating element, is formed with a curved surface inclined towards the actuator or the controlling element, so that a respective bearing point is fixed exactly and is scarcely displaced upon a tilting of the actuator or the controlling element.

The transmission element between the compensating element and the controlling element leads to several advantageous effects. For example, the deflection of the actuator is preferably increased by means of the transmission element. If a plurality of transmission elements are used, different overall heights of the transmission elements are compensated for in an advantageous way by the compensating element. Consequently, in spite of the different overall height of the transmission elements, low-wear operation becomes possible, since both transmission elements are loaded with an identical force.

Other features which are considered as characteristic for the invention are set forth in the appended claims.

Although the invention is illustrated and described herein as embodied in an injection valve with a compensating surface, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

It will be understood by those of skill in the art that the invention can be used for any device in which a deflection or a force is transmitted between an actuator and a transmission element or a controlling element. The essential features of the invention will be explained below with reference to an injection valve.

Figure 1:
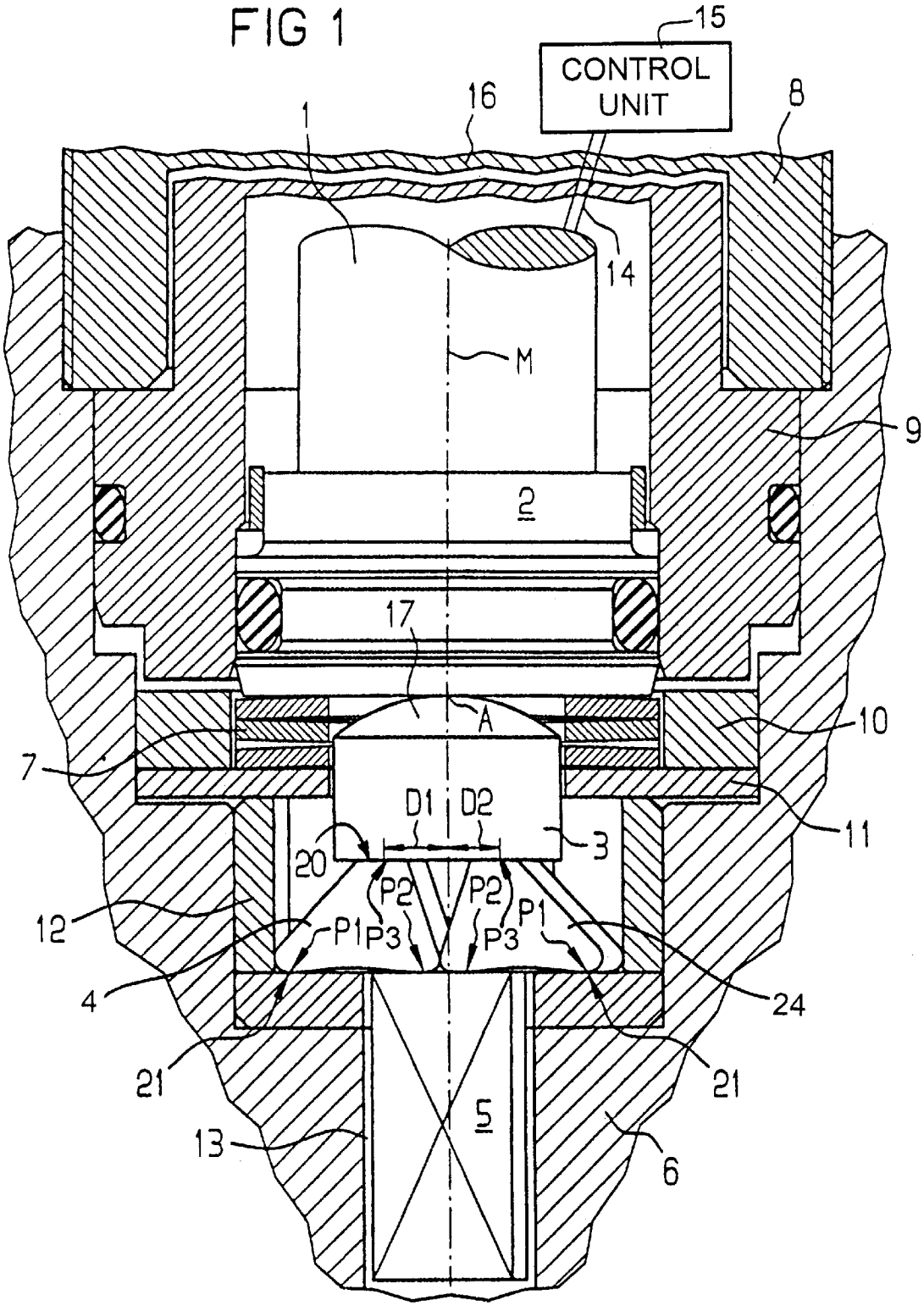
FIG. 1 is a partial sectional view of an injection valve.

Referring now to the figures of the drawing in detail and first, particularly, to FIG. 1 thereof, there is seen a part of an injection valve with a piezoelectric actuator 1 which is guided in a guide ring 9 and which is fixedly connected to a pressure plate 2 bearing on a top side of a compensating element 3. The compensating element 3 bears with its underside 20 on two transmission elements 4, 24. The transmission elements 4, 24 have, in longitudinal section, essentially a triangular shape which is rounded at the corners. The triangular shape is delimited by a peripheral side face which defines a width of the transmission elements 4, 24. The peripheral side face is rounded in the peripheral direction, particularly in the regions in which the side face bears on the compensating element 3 or on a controlling element 5. By virtue of the rounded shape, the frictional resistance between the transmission element 4, 24 and the compensating element 3 is reduced and the wear during the movement of the transmission elements is kept low. As will become clear from the following description, it is equally possible to provide for more or fewer transmission elements instead of the two transmission elements.

Each transmission element 4, 24 bears with a first bearing point P1 on a bearing surface 21 of the housing 6 and with a second bearing point P2 on the controlling element 5. The latter is guided moveably in a bore 13 of the housing 6. Each transmission element 4, 24 bears with a third bearing point P3 on the underside 20 of the compensating element 3. The controlling element 5 is, for example, connected directly to an injection needle of the injection valve or to a closing member of a servovalve. Between the first and second bearing points P1, P2, the transmission element 4, 24 has a curved recess which ensures that, during the movement of the transmission element 4, 24, the latter bears only with the first bearing point P1 on the bearing surface 21 and the movement of the transmission element 4, 24 is not impeded.

Instead of the transmission elements illustrated, other forms, in particular levers, may also be used, by means of which the deflection of the actuator is converted into a greater deflection of the controlling member.

The piezoelectric actuator 1 is connected via control lines 14 to a control unit 15 and is supported with its closed-off side against an end plate 16 in the guide ring 9. A hollow screw 8 sets a functionally induced distance between the pressure plate 2 and the compensating element 3 via the guide ring 9. Between the guide ring 9 and the bearing surface 21 is provided a spring guide disk 10 which rests on the bearing ring 11 and which is arranged level with the compensating element 3, the compensating element 3 being arranged in the central recess of the spring guide disk 10.

Spring elements 7 are arranged between the bearing ring 11 and the pressure plate 2. The spring elements 7 surround the compensating element 3 and are introduced in the recess of the spring guide disk 10. The spring elements 7 prestress the piezoelectric actuator 1 against the end plate 16. The spring elements 7 are designed as plate springs having a central recess, in which the compensating element 3 is arranged.

The compensating element 3 is in the form of a cylinder which, on its top side 17, has a concave curvature which, in the preferred design, is part-spherical. For the functioning of the curvature, it is sufficient if at least that region of the top side 17 against which the pressure plate 2 bears on the compensating element 3 has a positive curvature toward the pressure plate 2. The point at which the pressure plate 2 bears on the top side 17 is designated as the bearing point A which is located in the center axis of symmetry M of the injection valve and centrally in the cross section of the compensating element 3. The underside 20 of the compensating element 3 constitutes a plane surface, on which the first and second transmission elements 4, 24 in each case bear at the third bearing point P3. The lateral distances D1, D2 between the third bearing point P3 of the first and second transmission elements 4, 24 and the center axis of symmetry M are identical: D1=D2.

The compensating element 3 is guided in the axial direction of movement of the actuator 1 by the bearing ring 11 and by a guide disk 12. The guide disk 12 is arranged between the bearing ring 11 and the bearing surface 21 and surrounds the compensating element 3 at least partially.

The injection valve of FIG. 1 functions in the way described below: the control unit 15 sends a control signal to the piezoelectric actuator 1 which thereupon expands counter to the spring force of the spring elements 7 and at the same time presses the compensating element 3 against the transmission elements 4, 24. The transmission elements 4, 24 bear in each case with the first bearing point P1 on the housing 6 and with the second bearing point P2 on the controlling element 5. As a result of the pressure in the direction of the controlling element 5, the first and second transmission elements 4, 24 act as levers which are supported on the first bearing point P1 and which press the controlling element 5 downward via the second bearing point P2. At the same time, the controlling element 5 opens, say, a servovalve or moves an injection needle.

Figure 2:
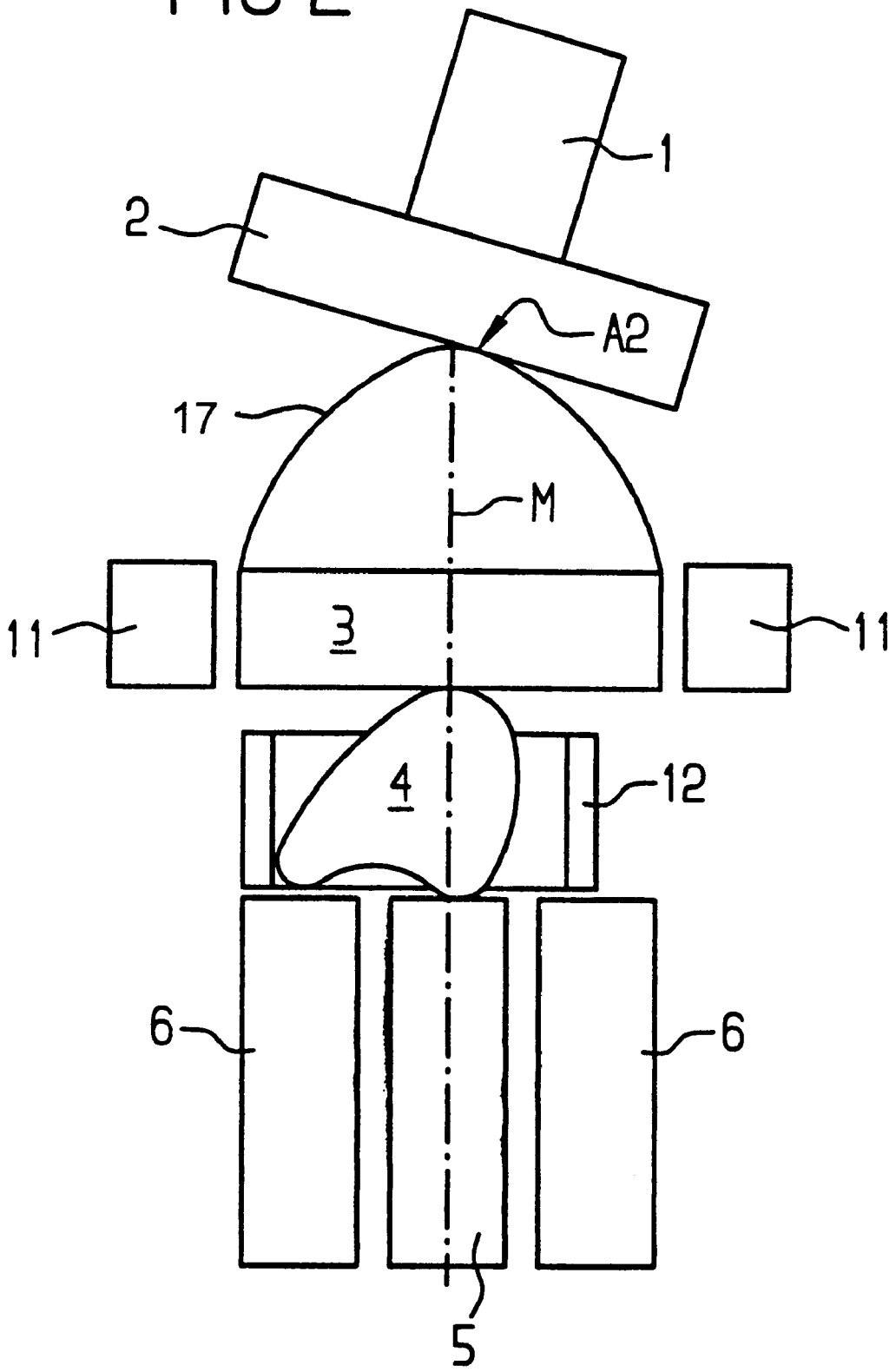
FIG. 2 is a diagrammatic elevational view of an injection valve with a transmission element.

If, then, the piezoelectric actuator 1 and the pressure plate 2 are maladjusted, as illustrated diagrammatically in FIG. 2, then, due to the curved surface of the top side 17 of the compensating element 3, the bearing point A is not displaced, or only slightly in the case of pronounced maladjustment, out of the predetermined position which is located in the center axis of symmetry M. As a result, even if the piezoelectric actuator 1 is inclined or tilted, the force continues to be transmitted in the center axis of symmetry M. A maladjustment of the actuator 1 is thus compensated for by the compensating element 3.

Figure 3:
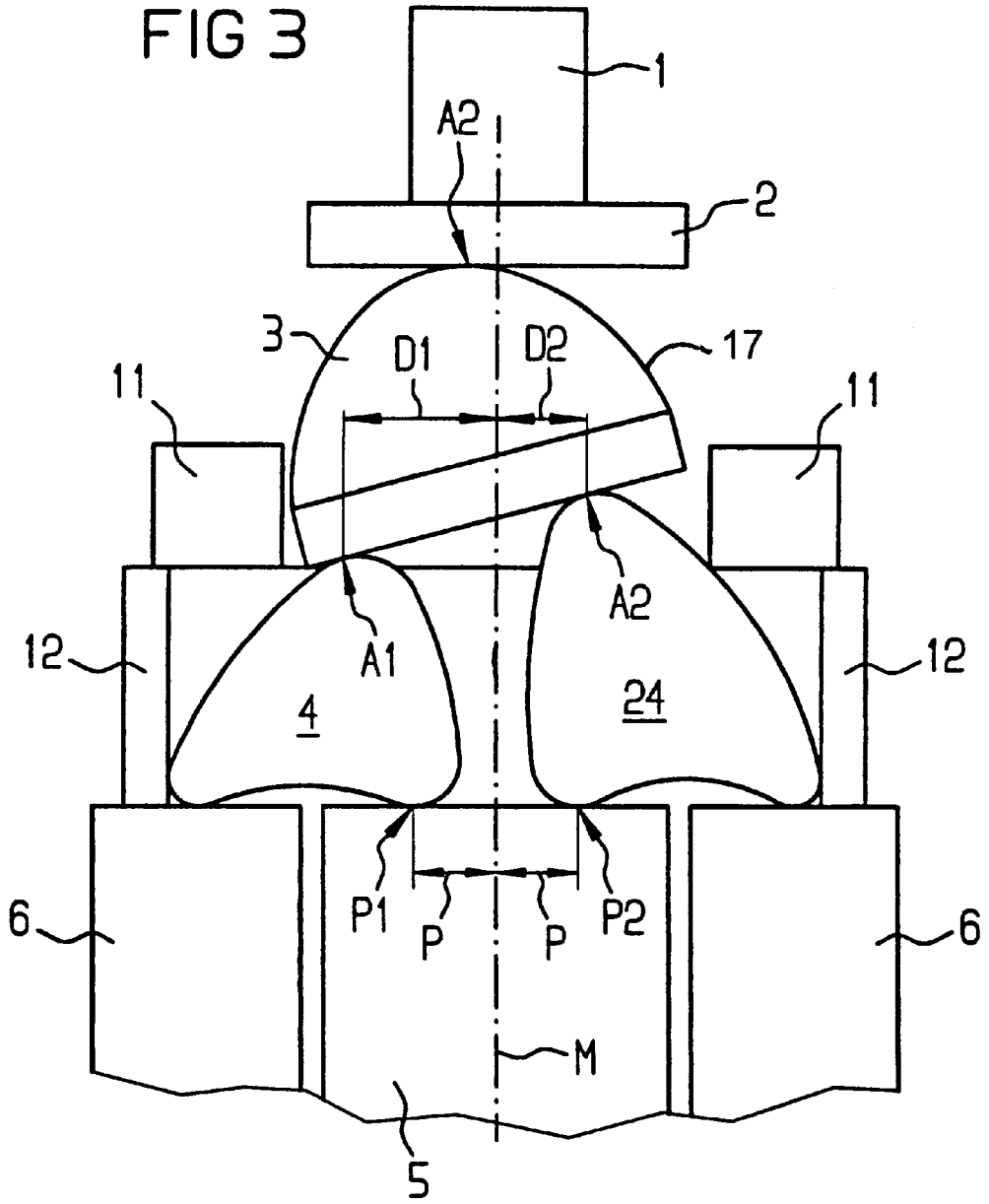
FIG. 3 is a similar diagrammatic elevational view of an injection valve with transmission elements of different height.

Moreover, the compensating element 3 according to the invention affords the advantage that, in the case of a first and a second transmission element 4, 24 which have a different overall height, low-wear operation is possible. If the transmission elements 4, 24 are of different height, the compensating element 3 tilts out of the horizontal position, as illustrated in FIG. 3. On account of the curved surface of the top side 17, even if the compensating element 3 is tilted, the bearing point A2, at which the piezoelectric actuator 1 or the pressure plate 2 bear on the compensating element 3, is not displaced out of the center axis of symmetry M. As a result, the force transmitted from the piezoelectric actuator 1 to the compensating element 3 continues to be transmitted uniformly to the first and the second transmission element 4, 24, since the pressure points P1 and P2 at which the force is transmitted are equidistant from the axis of symmetry (P=P), even though the pressure points A1 and A2 are unequally spaced from the center axis (D1>D2) from the center axis of symmetry M.

The compensating element 3 thus allows automatic distance compensation in the case of transmission elements 4, 24 of different height. So that the tilted compensating element 3 is not displaced laterally, it is guided by the bearing ring 11 and preferably by the guide disk 12 in the direction of movement of the actuator 1.

Figure 4:
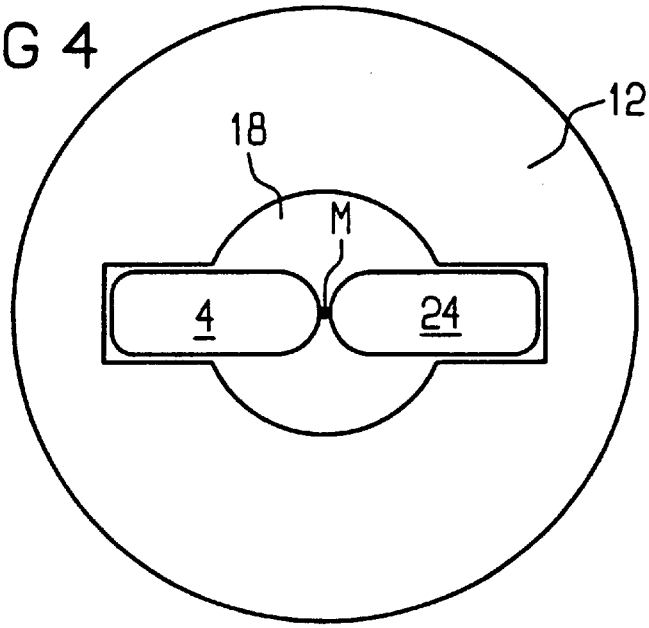
FIG. 4 is a plan view onto a guide disk with transmission elements.

The first and second transmission elements 4, 24 are fixed in their positions by the guide disk 12. For this purpose, as illustrated in FIG. 4, the guide disk 12 is formed with a guide recess 18. The guide recess 18 adjusts the first and second transmission elements 4, 24 symmetrically to the center axis of symmetry M and fixes the first and second transmission elements 4, 24 in the plane of the guide disk 12. The guide recess 18 has essentially the shape of a rectangle which merges centrally into a circular shape. This circular shape ensures that both the movement of the controlling element 5 and the movement of the compensating element 3 are not impeded by the guide disk 12. Moreover, the circular shape serves for receiving the compensating element 3 which is also guided by the guide disk 12.

In the case of only one transmission element 4, as illustrated in FIG. 2, the guide disk 12 has preferably only one rectangular recess, in which the transmission element 4 is guided. However, so that the movement of the compensating element 3 or of the controlling element 5 is not impeded in this arrangement, the overall height of the transmission element 4 is greater than the overall height of the guide disk 12, so that the transmission element 4 projects above and below the guide disk 12 to an extent such that there is sufficient play for movement of the compensating element 3 and of the controlling element 5. Alternatively, the guide disk 12 may also have formed in it a central bore which is adapted to the cross section of the compensating element 3 and at least partially receives the latter and which guides the compensating element 3 in the direction of movement of the actuator 1.

Figure 5:
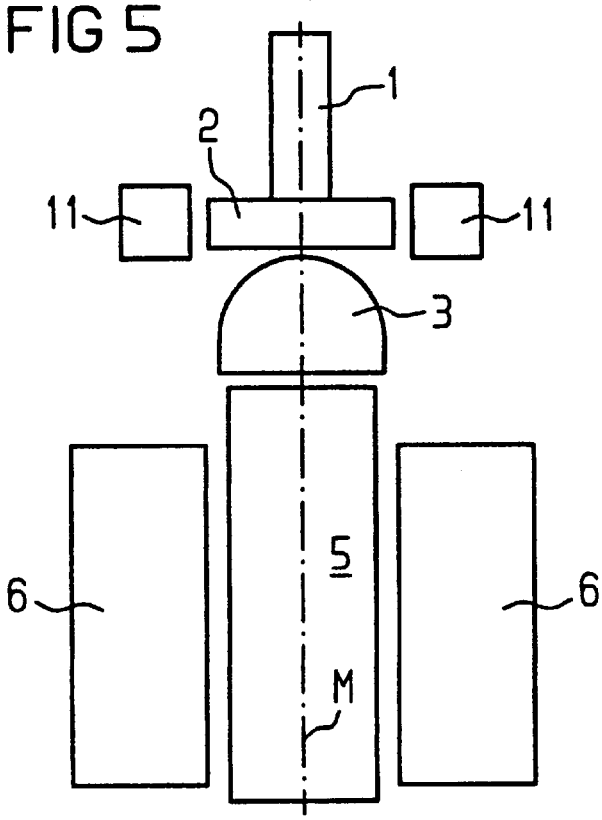
FIG. 5 is a diagrammatic elevational view of an injection valve without transmission elements.

With reference to FIG. 5, there is shown a further embodiment of the injection valve, in which the compensating element 3 bears directly on the controlling element 5 and no transmission elements 4, 24 are provided.

Figure 6:
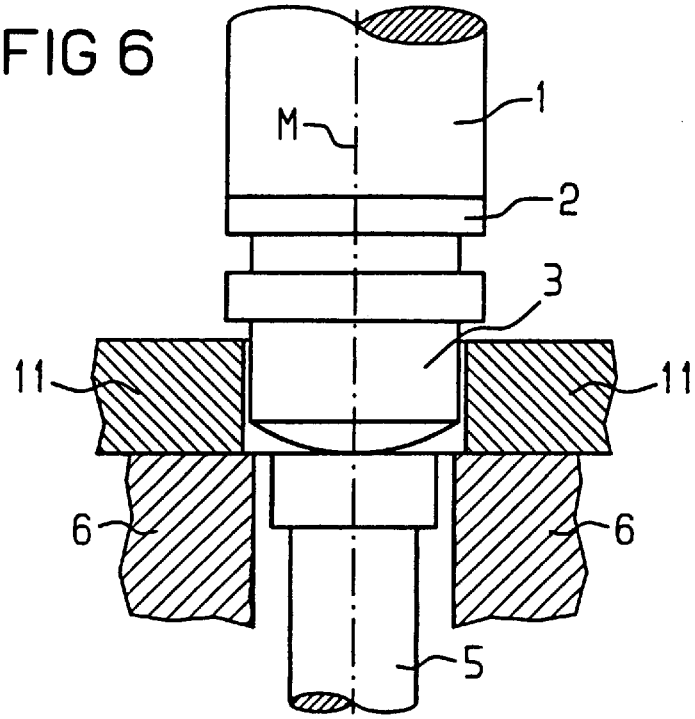
FIG. 6 is a partly sectional, partly elevational view of a compensating element, with one curved surface assigned to the controlling element.

In FIG. 6, the compensating element 3 having a curved underside which bears on the controlling element 5. The controlling element 5 has a plane end face which bears against the compensating element 3.

Figure 7:
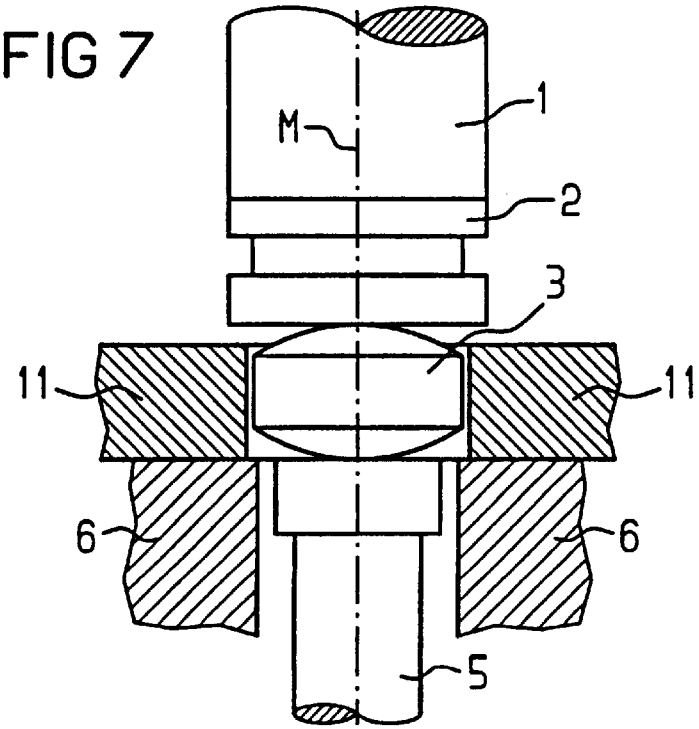
FIG. 7 is a partly sectional, partly elevational view of a compensating element with two curved surfaces.

FIG. 7 shows a further embodiment of the compensating element 3 which has a curved top side and a curved underside. The curvature of the top side bears against the actuator 1 and the curvature of the underside bears against the controlling element 5, i.e., the actuator 1 and the controlling element 5 bear respectively on the curved top side and on the curved underside. The bearing points, at which the actuator and the controlling element bear on the compensating element 3, are arranged in the center axis of symmetry M. In this embodiment, the compensating element 3 is guided in the direction of movement of the actuator 3 by a higher bearing ring 11. Any maladjustments of the actuator and of the controlling element are compensated by means of this compensating element 3 curved on two sides. The actuator 1 bears with a plane end face on the compensating element 3.

Figure 8:
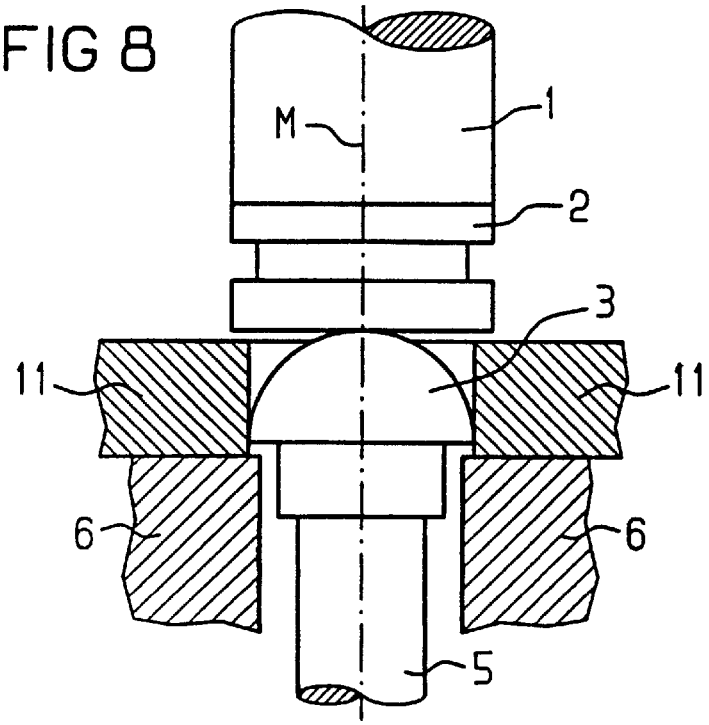
FIG. 8 is a partly sectional, partly elevational view of a compensating element formed as a partial sphere.

FIG. 8 shows a further particular design of the compensating element 3 which, in this example, is in the shape of a part-sphere, preferably in the shape of a hemisphere. The production of the compensating element 3 can thereby be carried out in a simple way.

Figure 9:
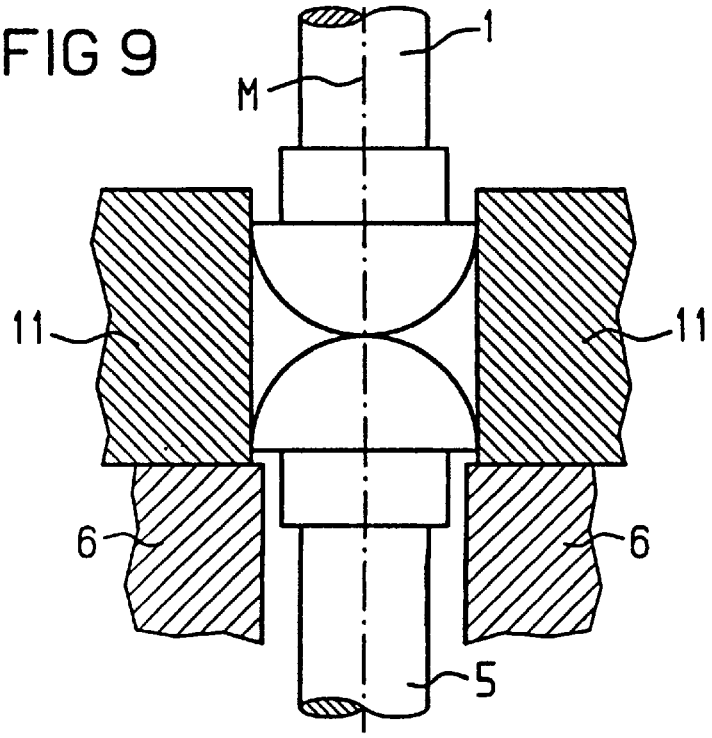
FIG. 9 is a partly sectional, partly elevational view of an actuator and a controlling element with curved surfaces bearing on one another.

The essential premise of the invention is to compensate for a maladjustment of the actuator and/or of the controlling element by the arrangement of at least one curved surface between the actuator and the controlling element. The curved surface may, of course, also be formed directly on the end of the actuator 1, for example on the pressure plate 2, or on the end of the controlling element 5. A corresponding design is illustrated in FIG. 9.

The use of a separate compensating element 3 affords the advantage, moreover, that the curved surfaces can be produced more simply on the compensating element 3 than on the actuator 1 or the pressure plate 2 or on the controlling element 5. A further improvement in compensation is achieved if, in the arrangement of FIG. 9, a compensating element 3 with one or two curved surfaces according to FIGS. 1, 6 and 7 is arranged between the curved surface or curved surfaces of the actuator 1 and/or of the controlling element 5.

We claim:

1. An actuator assembly for an injection valve of an internal combustion engine, comprising:

a housing;

an actuator disposed in said housing and movably guided in said housing along a given direction of movement;

a controlling element moveably guided along said given direction of movement and being operatively connected to said actuator via at least one partially curved surface;

a compensating element moveably disposed in said housing between said controlling element and said actuator, said actuator and said controlling element bearing against said compensating element and said compensating element being formed with said at least one partially curved surface; and said compensating element, in a region bearing against one of said actuator and said controlling element, having a curvature inclined to said respective actuator or controlling element, such that a bearing point at which said compensating element bears against said one of said actuator and said controlling element is fixed exactly and is not displaced upon a tilting of said one of said actuator and said controlling element in any direction but said given direction of movement.

2. The assembly according to claim 1, which further comprises a transmission element disposed between said compensating element and said controlling element;

said transmission element bearing against said housing at a first bearing point, against said controlling element at a second bearing point, and against said compensating element at a third bearing point; and said compensating element having a substantially plane surface at said third bearing point and said partially curved surface facing towards said actuator.

3. The assembly according to claim 2, wherein said transmission element is one of two substantially identical transmission elements including a first transmission element and a second transmission element, said second transmission element is disposed between said compensating element and said controlling element and, together with said first transmission element, symmetrically to a center axis of symmetry of the assembly.

4. The assembly according to claim 3, wherein said first transmission element bears against said controlling element at said second bearing point, said second transmission element bears against said controlling element at a fourth bearing point, and said second and said fourth bearing points are equidistant from the center axis of symmetry.

5. The assembly according to claim 2, wherein said first bearing point and said second bearing point are disposed approximately on a common plane, and said third bearing point is located between said first and second bearing points, as seen projected onto the common plane.

6. The assembly according to claim 1, wherein said compensating element is guided laterally in the direction of movement of the actuator by said housing.

7. The assembly according to claim 1, wherein said compensating element is formed as a part-sphere.

8. The assembly according to claim 1, wherein said compensating element is guided in said housing in the direction of movement of said actuator, said compensating element is a cylindrical body having a top side defining a part-spherical surface and a substantially planar underside, said actuator has a substantially planar surface bearing against said part-spherical surface, and said controlling element bears against the substantially planar underside of said compensating element.

9. The assembly according to claim 1, wherein said actuator is formed with said partially curved surface towards said controlling element.

10. The assembly according to claim 1, wherein said controlling element is formed with said partially curved surface towards said actuator.

11. An actuator assembly for an injection valve of an internal combustion engine, comprising:

a housing;

an actuator with at least one partially curved surface, said actuator disposed in said housing and movably guided in said housing along a given direction of movement; and a controlling element moveably guided along said given direction of movement and being operatively connected to said actuator via said at least one partially curved surface of said actuator;

a compensating element moveably disposed in said housing between said controlling element and said actuator;

said actuator and said controlling element bearing against said compensating element; and said compensating element, at least in a region wherein one of said actuator and said controlling element bears against said compensating element, being formed with a partially curved surface inclined towards said one of said actuator and said controlling element, so that a respective bearing point is fixed exactly and is not displaced upon a tilting of said one of said actuator and said controlling element in any direction but said given direction of movement.

12. An actuator assembly for an injection valve of an internal combustion engine, comprising:

a housing;

an actuator disposed in said housing and movably guided in said housing along a given direction of movement;

a controlling element with at least one partially curved surface, said controlling element moveably guided along said given direction of movement and being operatively connected to said actuator via said at least one partially curved surface;

a compensating element moveably disposed in said housing between said controlling element and said actuator;

said actuator and said controlling element bearing against said compensating element; and said compensating element, at least in a region wherein one of said actuator and said controlling element bears against said compensating element, being formed with a partially curved surface inclined towards said one of said actuator and said controlling element, so that a respective bearing point is fixed exactly and is not displaced upon a tilting of said one of said actuator and said controlling element in any direction but said given direction of movement.

* * * * *